United States Patent [19]

Oppenberg

[11] Patent Number: 4,979,894

[45] Date of Patent: Dec. 25, 1990

[54] ARRANGEMENT FOR BURNING FUELS IN A NARROW COMBUSTION SPACE

[75] Inventor: Rolf Oppenberg, Wesel, Fed. Rep. of Germany

[73] Assignee: Deutsche Babcock Werke Aktiengesellschaft, Oberhausen, Fed. Rep. of Germany

[21] Appl. No.: 373,988

[22] Filed: Jun. 29, 1989

[30] Foreign Application Priority Data

Jun. 30, 1988 [DE] Fed. Rep. of Germany ..... 3822004

[51] Int. Cl.[5] ..... F23L 9/00

[52] U.S. Cl. ..... 431/116; 431/284; 431/188; 431/182

[58] Field of Search ..... 431/284, 285, 278, 115, 431/116, 9, 10, 182, 187, 188

[56] References Cited

U.S. PATENT DOCUMENTS 4,162,140 7/1979 Reed ..... 431/284
4,380,429 4/1983 Lahaye et al. ..... 431/115
4,575,332 3/1986 Oppenberg ..... 431/116

FOREIGN PATENT DOCUMENTS 26308 2/1982 Japan ..... 431/115

*Primary Examiner*—James C. Yeung
*Attorney, Agent, or Firm*—Max Fogiel

[57] ABSTRACT

A burner for burning gaseous and/or liquid fuels in a combustion space (5), through the face (3) of which an oil lance (12) and/or several gas lances (13 and 14) extend. The oil lance and at least some of the gas lances are surrounded by an air pipe (4) that supplies primary air with its outer surface demarcating a flue-gas recirculation channel that opens toward the combustion space and surrounded by a source of secondary air. The air pipe and the source of secondary air extend into the combustion space. The air pipe is surrounded inside the combustion space by a baffle (20) that is axially separated from the face of the combustion space. Some of the gas lances surround the air pipe and are mounted on a sector with a diameter that is shorter than the longest diameter of the baffle.

11 Claims, 3 Drawing Sheets

ARRANGEMENT FOR BURNING FUELS IN A NARROW COMBUSTION SPACE

BACKGROUND OF THE INVENTION

The invention concerns a burner for burning gaseous and/or liquid fuels in a narrow combustion space.

A burner of this type is employed for the low-$NO_x$ combustion of fuels. The formation of nitrogen oxides is suppressed in a known burner (German OS 3 327 597) by supplying air discontinuously and exploiting it to generate an injector action that forces extensively burned-out flue gases out of the combustion space. The flue gases are forwarded to the point where flaming is initiated between the primary-air and secondary-air intakes. Since this known burner is employed to heat large combustion spaces, the air line and the flue-gas recirculation channel are located in the burner flute outside the combustion space to protect them from the heat.

In narrow combustion chambers of the type demarcated by the flame tube of a flame-tube boiler that is heated by a burner, the substances flowing out of the burner tend to piston. A flow of this type loses subsidiary currents that contain incompletely burned-out flue gas. In the method employed with flame-tube boiler burners of the type disclosed in German OS 3 327 597 accordingly, the incompletely burned-out gas is forwarded to the flame-initiation point. This approach, however, does not completely attain the object of extensively suppressing the formation of nitrogen oxides.

SUMMARY OF THE INVENTION

The object of the present invention is to improve the generic burner to the extent that the formation of nitrogen oxides is effectively suppressed even in narrow combustion spaces.

The baffle of the burner in accordance with the present invention channels the expanding mixture of combustion air and flue gas and diverts the flame to the center of the combustion space, preventing the flame from flashing back into the recirculation area, which only burned-out gas can enter. Since some of the gas lances extend into the recirculation area, the exiting flow of gas increases the injector action that produces the recirculation. The combustion gas, however, is also diluted and its calorific value decreased to some extent, which also helps to decrease the formation of nitrogen oxide. The conical baffle results in a narrow flame. The constriction of the flame is augmented by bending down the inner edge of the baffle.

Various embodiments of the invention will now be described with reference to the drawing.

DESCRIPTION OF THE PREFERRED EMBODIMENTS

Figure 1:
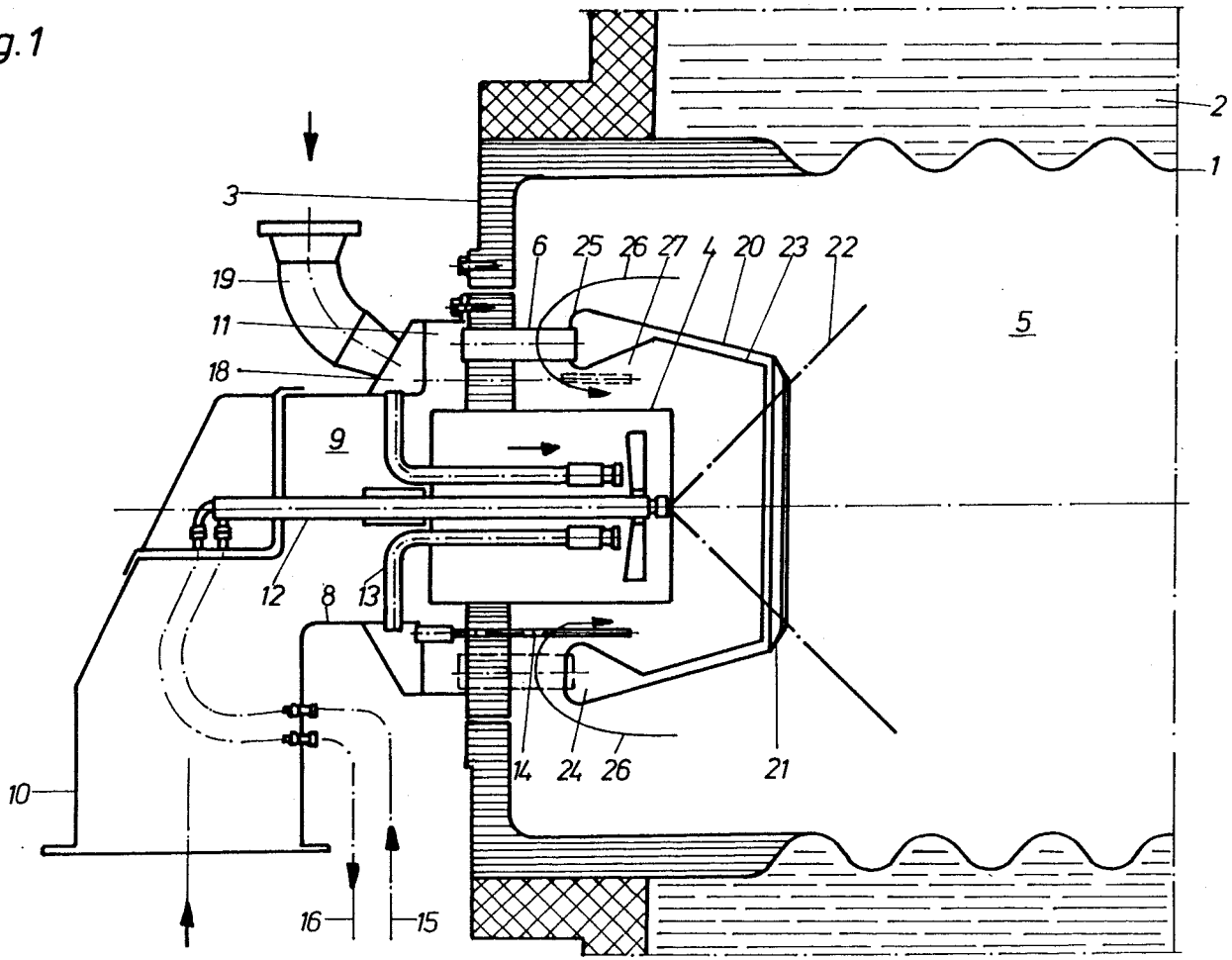
FIGS. 1 through 3 are sectional views through various embodiments of the burner.

Only the burner-end section of a flame tube 1 is illustrated. It is surrounded by a water jacket 2 and terminates in a solid face 3. Flanged to face 3 is a burner that consists of an air pipe 4 and of lances that extend into a combustion space 5 demarcated by flame tube 1.

Figure 2:
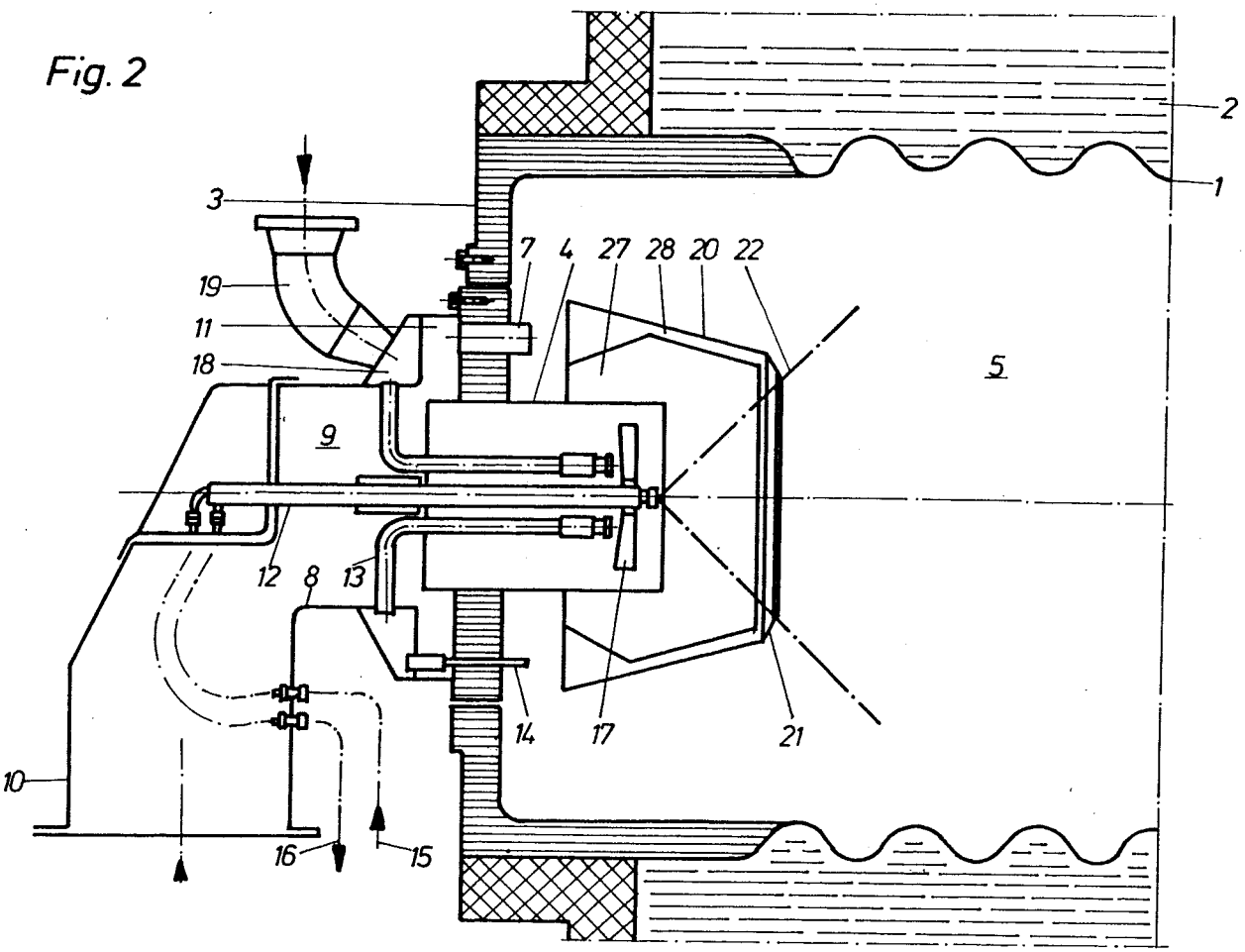
Figure 3:
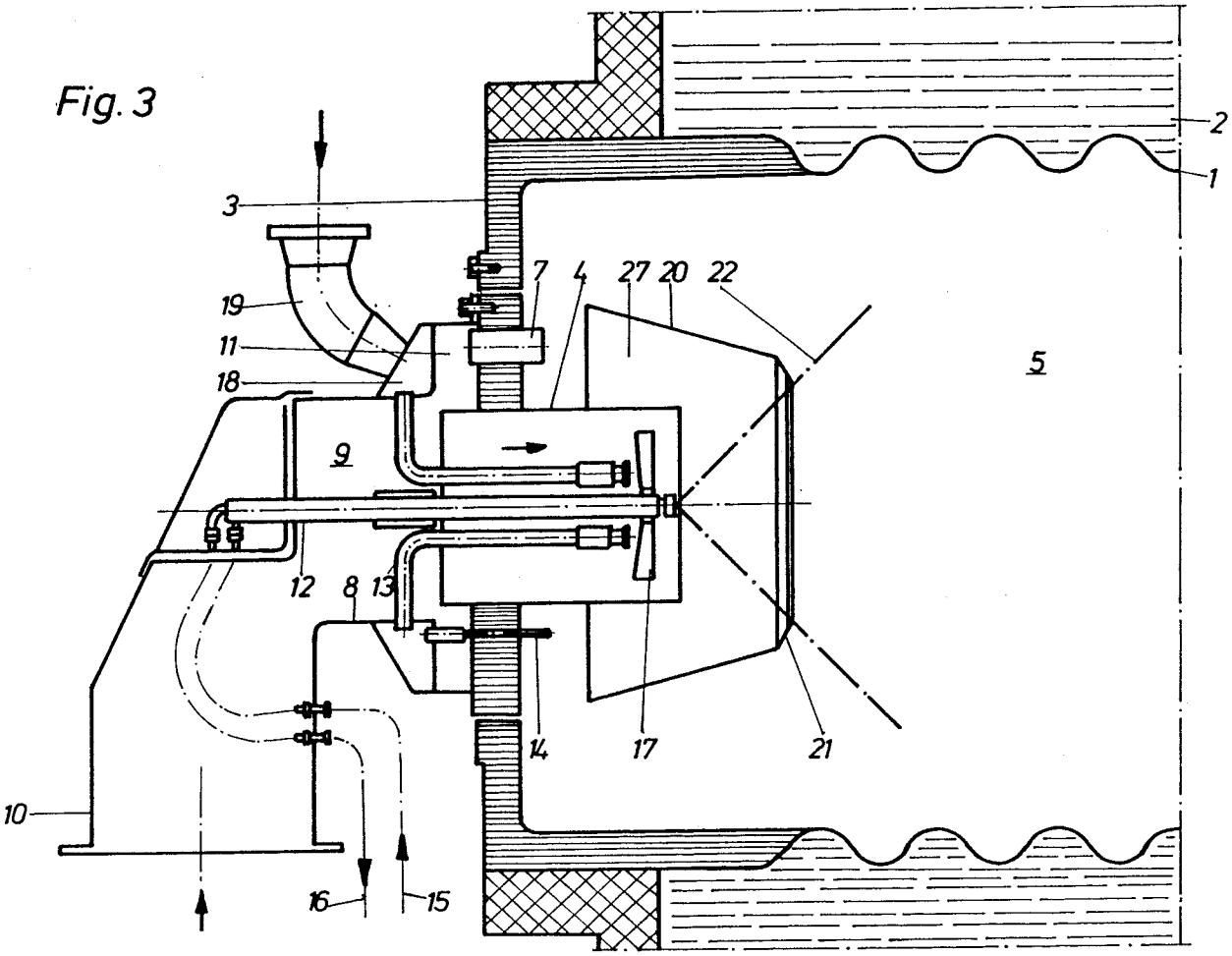

Air pipe 4 supplies primary air and is surrounded by a source of secondary air created by connecting pipes 6 (FIG. 1) or nozzle pipes 7 (FIGS. 2 & 3). Air pipe 4 and the source of secondary air communicate with an intake pipe 8 that is flanged at the end facing away from combustion space 5 to face 3. The initial section 9 of intake pipe 8 communicates with an air line 10. The diameter of initial section 9 is slightly longer than that of air pipe 4. Extending from initial section 9 to face 3 is another section 11 of more extensive cross-section with a diameter that is longer than the sector that the connecting pipes 6 or nozzle pipes 7 that supply secondary air are mounted on.

The lances consist of an oil lance 12 and of gas lances 13 and 14. Oil lance 12 is preferably a recirculation vaporizer with an oil intake 15 and an oil recirculator 16 and is positioned along the midline of air pipe 4. Oil lance 12 is surrounded by an impeller 17 that is accommodated along with its outlet inside air pipe 4.

Gas lances 13 and 14 are positioned both around oil lance 12 inside air pipe 4 and on a sector outside it. They communicate with a collecting channel 18 that is supplied from a gas line 19. Collecting channel 18 surrounds the initial section 9 of intake pipe 8 and extends to its second section 11. This design saves space outside the boiler. The number and cross-sections of gas lances 13 and 14 ensure that most, 80% for example, of the incoming combustion gas is supplied to the outer gas lances 14 that surround air pipe 4.

Air pipe 4 is surrounded inside combustion space 5 by a baffle 20. Baffle 20 is positioned axially away from the face 3 of combustion space 5 and rests against air pipe 4. Baffle 20 tapers in along the longitudinal axis of combustion space 5, and its shortest diameter is longer than the diameter of air pipe 4. The front edge 21 of baffle 20 bends down toward the longitudinal axis of combustion space 5. Baffle 20 extends toward combustion space 5 beyond the exit from air pipe 4. Oil lance 12 is positioned such that the cone 22 of fuel leaving oil lance 12 does not directly strike baffle 20.

Baffle 20 is made of a heat-resistant metal or ceramic material. The baffle 20 illustrated in FIG. 1 is double-walled and includes a space 23 that opens at one end into combustion space 5. Space 23 expands toward face 3, creating a collecting space 24, and terminates in a floor 25. Since space 23 communicates through connecting pipes 6 with the expanded second section 11 of intake pipe 8 by way of connecting pipes 6, secondary air flows through it. The secondary air is also exploited to cool baffle 20, subsequent to which it enters combustion space 5 in the capacity of combustion air downstream of the primary air.

The conical shape of baffle 20 diverts the flame toward the longitudinal axis of combustion space 5. The primary air that flows through air pipe 4 and baffle 20 produces an injector action inside the baffle that forces burned-out flue gas out of combustion space 5. As indicated by arrow 26 in FIG. 1, the flue gas is supplied to the flame-initiation point between the primary-air intake (through air pipe 4) and the secondary-air intake (through space 23) by way of an annular space 27 between air pipe 4 and baffle 20. Outer gas lances 14 extend into annular space 27. The combustion gas leaving gas lances 14 mixes with the recirculated flue gas, decreasing its specific calorific value and promoting the suppression of nitrogen oxide. The injector action is simultaneously augmented and can be increased by adjusting gas lances 14 axially.

The burners illustrated in FIGS. 2 and 3 differ from the burner illustrated in FIG. 1 in that the outer and preferably axially adjustable gas lances 14 extend into combustion space 5 less than the axial distance between baffle 20 and face 3. Furthermore, secondary air is supplied through nozzle pipes 7, the exits from which are not as far inside combustion space 5 as the exits from outer gas lances 14. The diameter of the sectors that nozzle pipes 7 and outer gas lances 14 are mounted on is longer than that of air pipe 4 and shorter than the longest diameter of baffle 20.

The space 28 inside the baffle 20 illustrated in FIG. 2 is open at each end. The cross-section of the entrance into space 28 is aligned with the axes of nozzle pipes 7 and outer gas lances 14. The baffle 20 illustrated in FIG. 3 is a simple sheet-metal jacket surrounding a space that is aligned with the axes of nozzle pipes 7 and outer gas lances 14. Secondary air is blown onto the sheet-metal jacket of baffle 20 to cool it. The baffle 20 illustrated in FIGS. 2 and 3 operates like the baffle 20 on the burner illustrated in FIG. 1.

What is claimed is:

1. A burner for burning fuels in a narrow combustion space, comprising: a combustion chamber with said combustion space and having a face member; a fuel lance and at least one gas lance extending through said face member; an air pipe surrounding said fuel lance and at least one gas lance for supplying primary air; a flue-gas recirculation channel formed by an outer surface of said air pipe and opening toward said combustion space; a source of secondary air surrounding said recirculation channel, said air pipe and said source of secondary air extending into said combustion space; a baffle surrounding said air pipe inside said combustion space and axially spaced from said face member, said baffle having a longest diameter; at least one gas lance surrounding said air pipe and mounted on a sector with a diameter shorter than the longest diameter of said baffle; said air pipe having an exit end within said baffle inside said combustion space, said baffle producing a flow of expanding air-flue gas mixture and preventing incompletely burned flue gas flows from separating and becoming recirculated by injection effects of said primary air, said baffle deflecting simultaneously a flame toward center of said combustion space so that the flue gas is completely burned; a part of said gas lance being located between said air pipe and said baffle, said gas lances extending into said recirculation channel for increasing said injection effects and reducing formation of nitrogen oxides.

2. A burner as defined in claim 1, wherein said baffle tapers toward the inside of said combustion space.

3. A burner as defined in claim 1, including connecting pipes connected to said source of secondary air; said baffle having double walls containing a space opening at one end into said combustion space and communicating through said connecting pipes with said source of secondary air.

4. A burner as defined in claim 3, wherein said at least one gas lance surrounding said air pipe extends into an annular space between said air pipe and said baffle.

5. A burner as defined in claim 1, wherein said baffle has an edge facing said combustion space and being bent in.

6. A burner as defined in claim 1, including an intake pipe communicating with said air pipe outside said combustion space; said intake pipe having a portion with cross-section larger than the cross-section of said intake pipe, said portion being located against said face member; and an annular collecting channel concentric with said portion and surrounding said intake pipe for supplying said at least one gas lance.

7. A burner as defined in claim 1, wherein said baffle is spaced from said face member by an axial distance, said at least one gas lance extending into said combustion space by an amount less than said axial distance.

8. A burner as defined in claim 1, wherein said source of secondary air comprises nozzle pipes, said baffle being spaced from said face member by an axial distance, said nozzle pipes extending into said combustion space by an amount less than said axial distance, said nozzle pipes being mounted on a sector with a diameter shorter than the longest diameter of said baffle.

9. A burner as defined in claim 1, wherein said baffle comprises a sheet-metal jacket, said source of secondary air comprising nozzle pipes with axes, a space between said air pipe and said air baffle being aligned with said axes of said nozzle pipes and said at least one gas lance surrounding said air pipe.

10. A burner as defined in claim 1, wherein said baffle has double walls and a space open at the ends of said baffle, said source of secondary air comprising nozzle pipes, said space with open ends of said baffle having an entrance cross-section aligned with axes of said nozzle pipes and said at least one gas lance surrounding said air pipe.

11. A burner for burning fuels in a narrow combustion space, comprising: a combustion chamber with said combustion space and having a face member; a fuel lance and at least one gas lance extending through said face member; an air pipe surrounding said fuel lance and at least one gas lance for supplying primary air; a flue-gas recirculation channel formed by an outer surface of said air pipe and opening toward said combustion space; a source of secondary air surrounding said recirculation channel, said air pipe and said source of secondary air extending into said combustion space; a baffle surrounding said air pipe inside said combustion space and axially spaced from said face member, said baffle having a longest diameter; at least one gas lance surrounding said air pipe and mounted on a sector with a diameter shorter than the longest diameter of said baffle; said air pipe having an exit end within said baffle inside said combustion space, said baffle producing a flow of expanding air-flue gas mixture and preventing incompletely burned flue gas flows from separating and becoming recirculated by injection effects of said primary air, said baffle deflecting simultaneously a flame toward center of said combustion space so that the flue gas is completely burned; a part of said gas lance being located between said air pipe and said baffle, said gas lances extending into said recirculation channel for increasing said injection effects and reducing formation of nitrogen oxides; said baffle tapering toward the inside of said combustion space; connecting pipes connected to said source of secondary air, said baffle having double walls containing a space opening at one end into said combustion space and communicating through said connecting pipes with said source of secondary air; said at least one gas lance surrounding said air pipe extending into an annular space between said air pipe and said baffle; said baffle having an edge facing said combustion space and being bent in; and intake pipe communicating with said air pipe outside said combustion space; said intake pipe having a portion with cross-section larger than the cross-section of said intake pipe, said portion being located against said face member; and an annular collecting channel concentric with said portion and surrounding said intake pipe for supplying said at least one gas lance.

* * * * *